US010517445B2

(12) United States Patent
Keily et al.

(10) Patent No.: US 10,517,445 B2
(45) Date of Patent: Dec. 31, 2019

(54) ROLL PAPER TOWEL OR TISSUE DISPENSER WITH SPRING DAMPENING ROLL SUPPORT

(71) Applicant: DISPENSING DYNAMICS INTERNATIONAL, LLC, City of Industry, CA (US)

(72) Inventors: Joel P. Keily, Corona, CA (US); Alexander Trampolski, Eastvale, CA (US)

(73) Assignee: DISPENSING DYNAMICS INTERNATIONAL, LLC, City of Industry, CA (US)

( * ) Notice: Subject to any disclaimer, the term of this patent is extended or adjusted under 35 U.S.C. 154(b) by 210 days.

(21) Appl. No.: 15/730,813

(22) Filed: Oct. 12, 2017

(65) Prior Publication Data

US 2019/0008333 A1 Jan. 10, 2019

Related U.S. Application Data

(60) Provisional application No. 62/407,674, filed on Oct. 13, 2016.

(51) Int. Cl.

| | |
|---|---|
| ***A47K 10/38*** | (2006.01) |
| ***A47K 10/36*** | (2006.01) |
| ***B26F 3/02*** | (2006.01) |
| ***B26D 1/62*** | (2006.01) |
| ***B26D 1/42*** | (2006.01) |

(52) U.S. Cl.

CPC ..... *A47K 10/3809* (2013.01); *A47K 10/3643* (2013.01); *B26D 1/425* (2013.01); *B26D 1/626* (2013.01); *B26F 3/02* (2013.01); *A47K 2010/365* (2013.01); *A47K 2010/3881* (2013.01)

(58) Field of Classification Search

CPC ..... A47K 10/40; A47K 10/3643; A47K 10/3662; A47K 10/3687; A47K 10/3809; A47K 10/3845; A47K 2010/3881; A47K 2010/365; A47K 2010/3681; B26D 1/425; B26D 1/626; B26F 3/02

See application file for complete search history.

(56) References Cited

U.S. PATENT DOCUMENTS

| | | | | |
|---|---|---|---|---|
| 2,711,860 | A * | 6/1955 | Layton | A47K 10/40 242/564 |
| 3,319,855 | A * | 5/1967 | Tucker | A47K 10/38 225/67 |
| 5,078,033 | A | 1/1992 | Formon | |
| 5,915,645 | A * | 6/1999 | Granger | A47K 10/3687 242/560 |
| 6,098,919 | A * | 8/2000 | Lewis | A47K 10/40 242/596.3 |
| 6,553,879 | B2 | 4/2003 | Morand | |
| 6,684,751 | B2 | 2/2004 | Kapiloff et al. | |
| 7,500,420 | B2 | 3/2009 | Cvjetkovic et al. | |
| 8,424,431 | B1 | 4/2013 | Jackman et al. | |
| 8,500,058 | B2 * | 8/2013 | Lan | B41J 15/042 242/578 |

(Continued)

*Primary Examiner* — William A. Rivera
(74) *Attorney, Agent, or Firm* — Thomas R. Lampe

(57) ABSTRACT

Dispenser apparatus for dispensing from a roll of sheet paper product supported by a support arm, a support member pivotally mounted on the support arm and a biasing structure operable to reduce the shock force in the sheet paper product by resisting pivotal movement of the support member.

8 Claims, 5 Drawing Sheets

(56) References Cited

U.S. PATENT DOCUMENTS

| | | | | |
|---|---|---|---|---|
| 8,899,508 | B2 | 12/2014 | Hjort et al. | |
| 2003/0025030 | A1* | 2/2003 | Granger | A47K 10/3643 242/596.3 |
| 2005/0199763 | A1* | 9/2005 | Myers | B65H 19/126 242/596.3 |
| 2009/0039099 | A1 | 2/2009 | Friesen et al. | |
| 2016/0157682 | A1 | 6/2016 | Keily et al. | |

* cited by examiner

ROLL PAPER TOWEL OR TISSUE DISPENSER WITH SPRING DAMPENING ROLL SUPPORT

This application is based on and claims the benefit of U.S. Provisional Patent Application No. 62/407,674, filed Oct. 13, 2016.

TECHNICAL FIELD

This invention relates to dispenser apparatus for dispensing paper toweling or tissue from a roll and more particularly to structure for dampening shock forces created when overspin slack is created.

BACKGROUND OF THE INVENTION

The present invention addresses certain problems, including the problem of "tabbing" occurring during use of a paper towel dispenser. Tabbing occurs when a piece of towel tears off the sheet when a user grasps and pulls the paper. Tabbing may occur with one or two hand pulls and with wet or dry hands. Papers that absorb water at the greatest rate are most likely to tab. The rate of water absorbency varies by paper manufacturer and grade. Premium grade papers tend to absorb water the quickest and are generally harder to cut which leads to a higher rate of tabbing.

It has been found that tabbing occurs when overspin slack is taken up and/or when a blade on the dispenser is utilized to cut the paper. A "shock" is present at the moment the overspin slack is exhausted. The shock occurs because the stationary roll towel must begin rotating at the moment that the overspin slack is exhausted. The shock is greatest with full rolls and diminishes as the roll is exhausted.

U.S. Pat. No. 7,500,420, issued Mar. 10, 2009, discloses an approach for addressing the "tabbing" problem. More particularly, the device shown therein dampen the shock through the utilization of shock absorbing nip rollers incorporated in the mechanism.

Other devices are used to control overspin rather than dampen the shock so as to avoid the conditions that create the overspin shock forces; however these devices are expensive and increase the average pull force required to dispense the toweling.

The following patent documents are believed to be representative of the current state of the art in this field: U.S. Pat. No. 6,553,879, issued Apr. 29, 2003, U.S. Pat. No. 6,684,751, issued Feb. 3, 2004, U.S. Pat. No. 8,424,431, issued Apr. 23, 2013, U.S. Pat. No. 8,899,508, issued Dec. 2, 2014, U.S. Pat. No. 5,078,033, issued Jan. 7, 1992, U.S. Patent App. Pub. No. US 2009/0039099, published Feb. 12, 2009 and U.S. Patent App. Pub. No. US 2016/0157682, published Jun. 9, 2016.

DISCLOSURE OF INVENTION

The present invention deals with the problems of "tabbing". The invention is characterized by its simplicity, reliability and effectiveness of operation.

The device of this invention operates by absorbing the shock force created when toweling overspin is depleted and the force required to overcome the moment of inertia of the roll to get the roll spinning when the force is applied. By reducing the peak shock force the toweling is less likely to tab.

The device of this invention incorporates a moveable roll support with built-in dampening. A moveable roll hub is employed to allow dampening.

More particularly, the device is a dispenser apparatus for dispensing a sheet of paper product from a roll thereof and includes first and second roll supports spaced from one another for rotatably supporting opposed ends of a roll of sheet paper product and allowing rotation of said roll about an axis of rotation during dispensing of the sheet paper product when a pulling force is exerted thereon.

At least one of said first and second roll supports comprises a support arm structure including a support arm and a support member on said support arm and pivotally movable relative to said support arm for supporting a roll end.

A biasing structure exerts a bias on the support member to resist pivotal movement thereof. The support arm structure is operable to reduce shock force created in the sheet paper product when slack exists therein between the roll and the location where the pulling force is applied to the sheet paper product.

Other features, advantages and objects of the present invention will become apparent with reference to the following description and accompanying drawings.

BEST MODE FOR CARRYING OUT THE INVENTION

Figure 1:
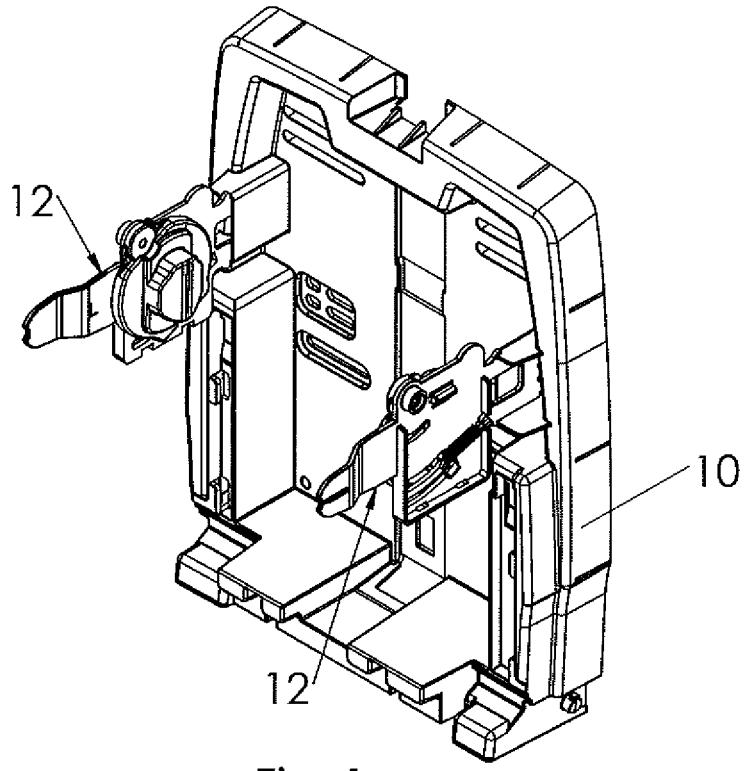
FIG. 1 is a perspective, frontal view illustrating the back portion of a paper toweling dispenser housing having roll support arm structures constructed in accordance with the teachings of the present invention projecting therefrom, the dispensing mechanism of the dispenser not being illustrated.
Figure 2:
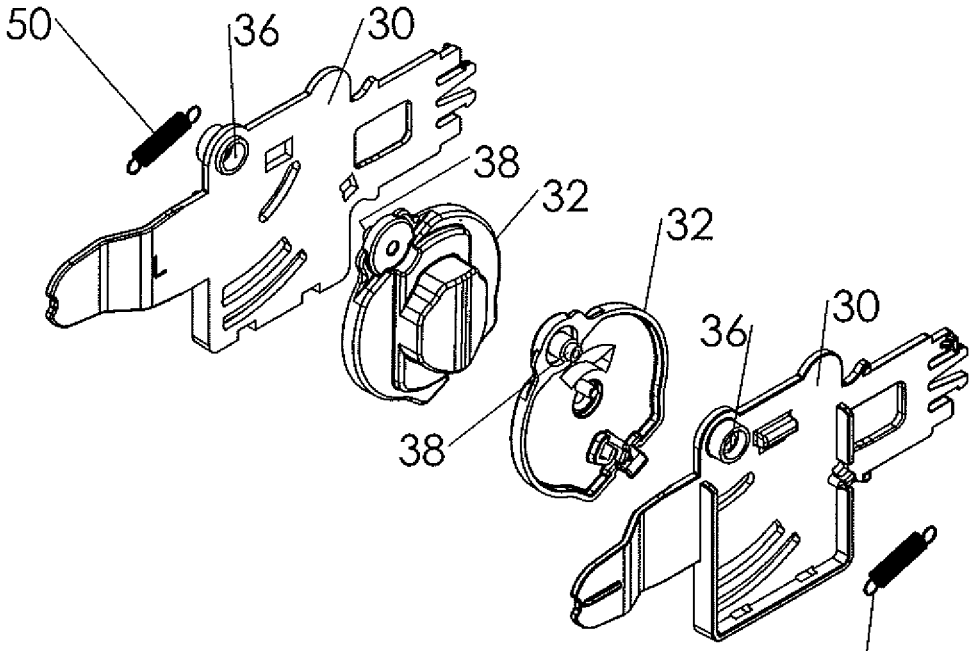
FIG. 2 is exploded, perspective view illustrating components of the support arm structures.
Figure 3:
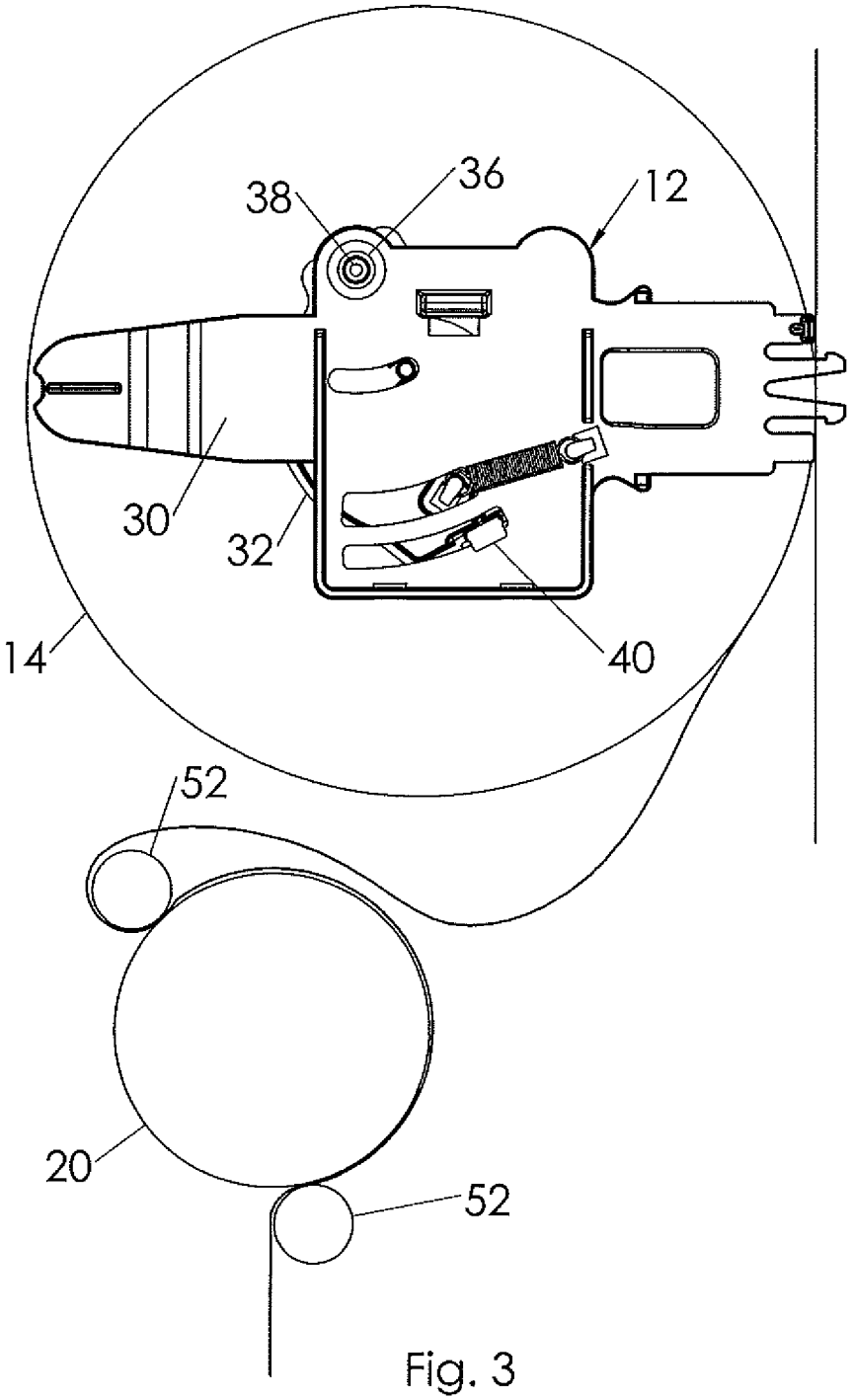
FIG. 3 is an enlarged outer side view of one of the support arm structures and showing a roll of toweling supported thereby in a resting position and with roll slack underneath an approximated paper path to a dispenser mechanism shown in diagrammatic fashion; a vertical line tangent to the resting roll position being shown for reference purposes.
Figure 4:
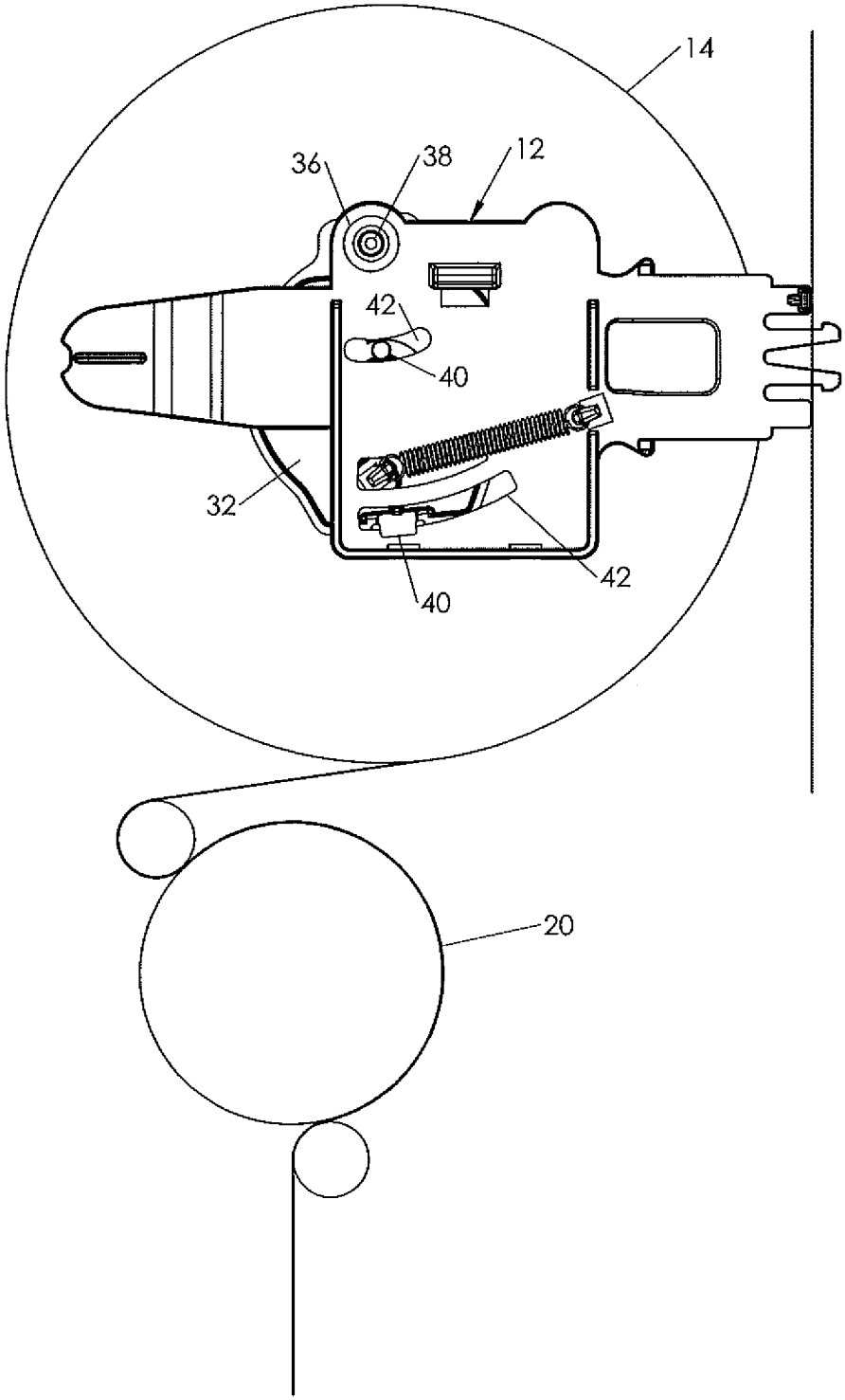
FIG. 4 is a view similar to FIG. 3, but illustrating a hub of the arm support structure pivoted and a spring of the arm support structure stretched, absorbing the overspin shock force, the roll displaced away from the vertical line tangent.
Figure 5:
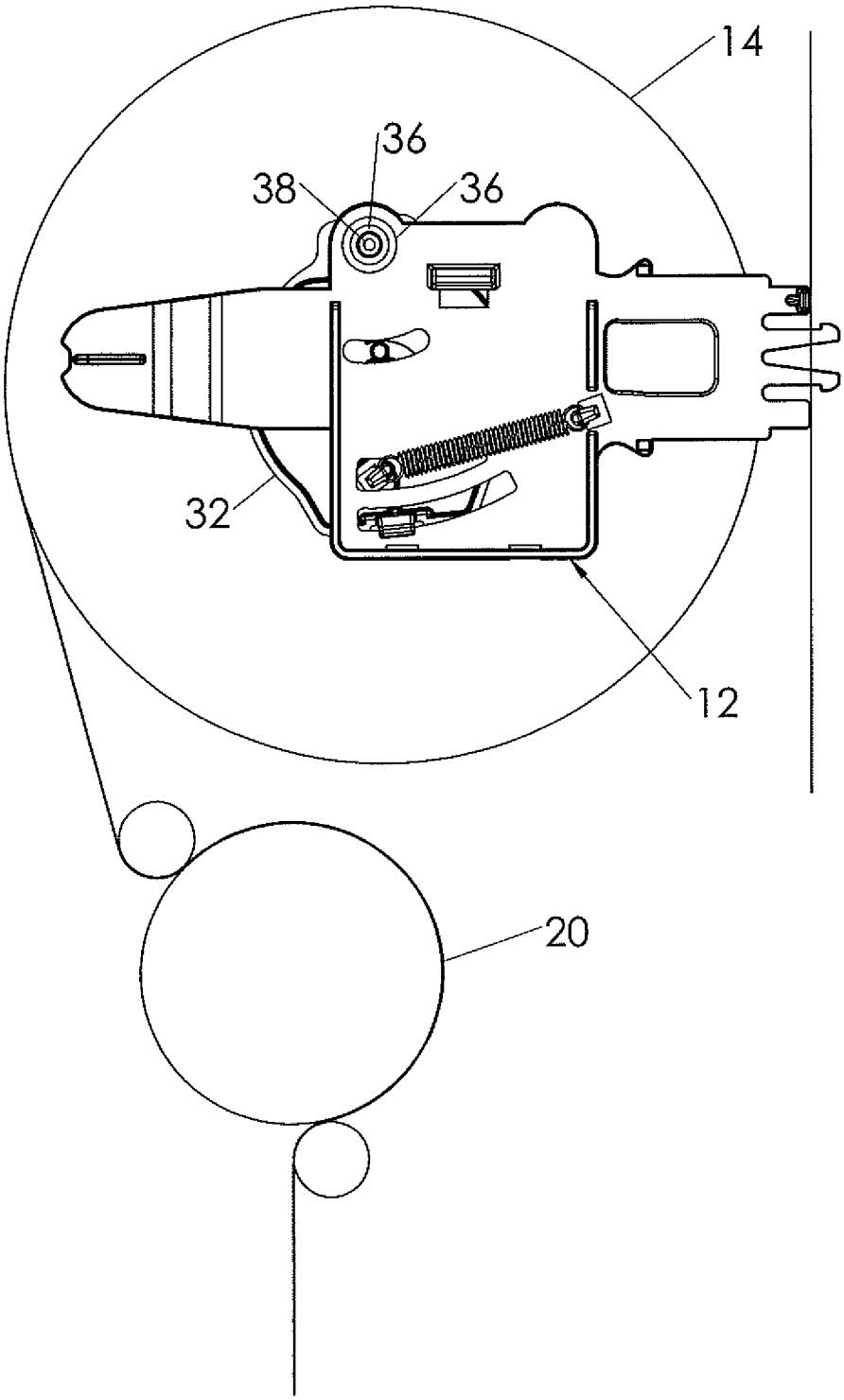
FIG. 5 is a view similar to FIG. 4, except that the leading edge of the toweling is loaded from the front instead of the back.
Figure 6:
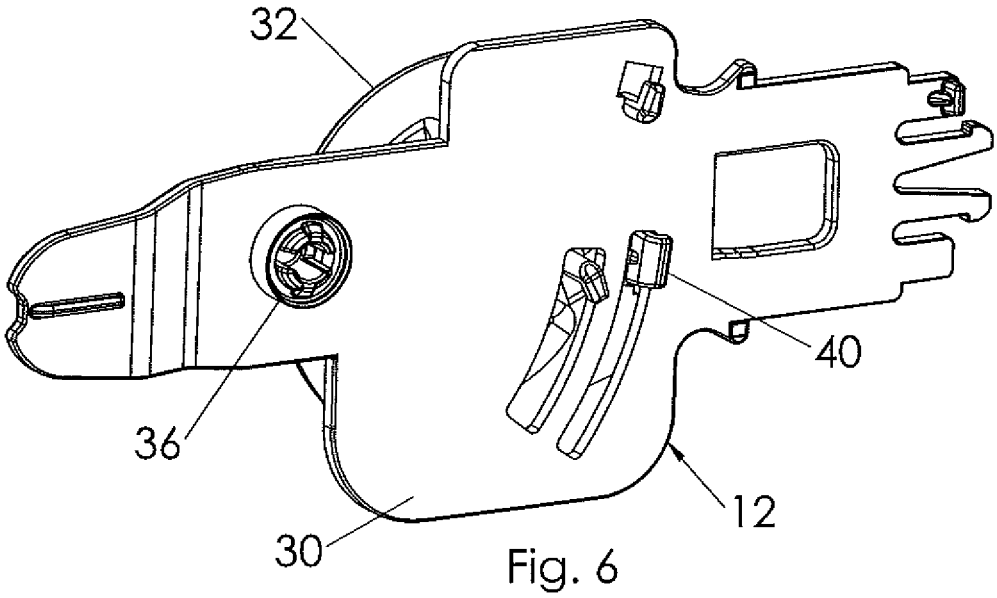
FIG. 6 is an enlarged, perspective, outer side view of a support arm structure without springs attached thereto.

Referring now to the drawings, a rear housing portion of a paper toweling dispenser incorporating the teachings of the present invention is illustrated, the housing portion being designated by reference numeral 10. The dispenser incorporates two support arm structures 12 which are used to rotatably support a roll of paper toweling to be dispensed. FIGS. 3-5 illustrates a supported paper toweling roll 14.

As is also conventional, the illustrated toweling dispenser will include a dispenser mechanism including a toweling support roller 20 which rotates during the dispensing operation and the toweling exits a dispensing opening (not shown). A retractable cutter blade operatively associated with the toweling support roller similar to the arrangement disclosed in above-referenced U.S. Pat. No. 7,500,420 may be utilized, but is not illustrated nor required to practice the present invention. The present invention is applicable to deal with virtually any type of paper toweling overspin wherein toweling overspin slack due to towel pull presents a problem.

The system of this invention may be utilized as the sole means for dealing with overspin shock or it may be utilized in conjunction with other systems, such as those referenced above, which address the problem at the dispensing mechanism employed in the dispenser.

In the disclosed invention of the invention the support arm structures 12 operate to absorb shock force created when toweling overspin is depleted and the force required to overcome the inertia of the roll to get the roll spinning by pivoting the roll when the force is applied. By reducing the peak shock force the toweling is less likely to tab.

In the illustrated embodiment such support arm structure 12 includes a support arm 30, proximal end portions of which are attached to the housing. The support arm structure also include roll end support members or hubs 32 which are mounted on the support arms at locations spaced from the locations of attachment of the support arms to the housing.

The support members 32 are pivotally mounted on the support arms. Pivoting takes place about pivots formed by recess defining elements 36 on the support arms and pivot stub shafts 38 on the hubs positioned in the recesses. The axes of pivot rotation of the hubs 32 are offset from the centers of the hubs.

The support members or hubs 32 include retention tabs 40 which enter slots 42 in the support arms to maintain the connection between the support arms and the support members while allowing and limiting the degree of pivotal movement of the support members (and toweling roll supported thereby), relative to the support arms.

The support arm structures also include springs 50 connecting the support arms and the support members or hubs. The springs are positioned to stretch and exert a bias to absorb shock force.

FIG. 3 shows roll of toweling 14 in a resting position with a roll toweling slack underneath. The slack deviates from the normal path of movement of the toweling to a representative mechanism towel dispensing including toweling support roller 20 and nip rollers 52.

FIG. 4 is similar to FIG. 3, except that the support member 32 has been positioned near maximum damping or maximum pivot and the spring stretched absorbing the overspin shock force.

FIG. 5 is similar to FIG. 4, except that the leading edge of toweling is loaded from the front instead of the back.

Figure 7:
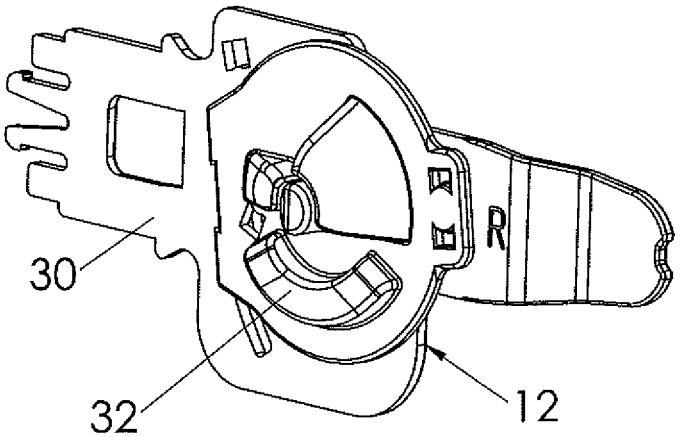
FIG. 7 is an enlarged, perspective, inner side view of the support arm structure as shown in FIG. 6 with the hub at resting position.
Figure 8:
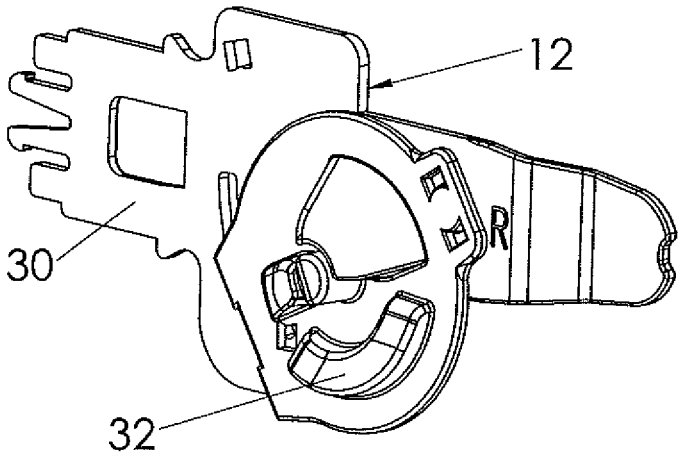
FIG. 8 is similar to FIG. 7, but showing the hub at max downward position.

In FIGS. 7 and 8 the hub 32 is shown respectively at minimal/maximum travel positions.

The invention claimed is:

1. Dispenser apparatus for dispensing a sheet of paper product from a roll thereof, said dispenser apparatus comprising:

first and second roll supports spaced from one another for rotatably supporting opposed ends of a roll of sheet paper product and allowing rotation of said roll about an axis of rotation during dispensing of said sheet paper product, at least one of said first and second roll supports comprising a support arm structure including a support arm and a support member on said support arm and pivotally movable relative to said support arm for supporting a roll end;

a biasing structure exerting a bias on said support member to resist pivotal movement thereof, said support arm structure operable to reduce shock force created in the sheet paper product when a pulling force is applied to the sheet paper product, said support member comprising a hub having a hub center axis substantially corresponding to the axis of rotation of said roll, said hub being pivotally movable relative to said support arm about a pivot axis offset from the hub center axis; and a pivot limiting structure limiting the degree of pivotal movement of said hub relative to said support arm, said pivot limiting structure including a slot defined by said support arm and a projection projecting from said hub and located in said slot.

2. The dispenser apparatus according to claim 1 including an interconnection between said hub and said support arm at said pivot axis.

3. The dispenser apparatus according to claim 1 wherein said slot is curved.

4. The dispenser apparatus according to claim 1 wherein said projection maintains a slidable interconnection between said support arm and said hub.

5. The dispenser apparatus according to claim 1 wherein said biasing structure is a spring.

6. The dispenser apparatus according to claim 5 wherein said spring is a tension spring extending between said support arm and said hub.

7. Dispenser apparatus for dispensing a sheet of paper product from a roll thereof, said dispenser apparatus comprising:

first and second roll supports spaced from one another for rotatably supporting opposed ends of a roll of sheet paper product and allowing rotation of said roll about an axis of rotation during dispensing of said sheet paper product when a pulling force is exerted thereon, at least one of said first and second roll supports comprising a support arm structure including a support arm and a support member on said support arm and pivotally movable relative to said support arm for supporting a roll end; and a biasing structure exerting a bias on said support member to resist pivotal movement thereof, said support arm structure operable to reduce shock force created in the sheet paper product when slack exists therein between the roll and the location where the pulling force is applied to the sheet paper product, said support member comprising a hub having a hub center axis substantially corresponding to the axis of rotation of said roll and wherein said hub is pivotally movable relative to said support arm about a pivot axis laterally offset from the hub center axis.

8. The dispenser apparatus according to claim 7 wherein the pivot axis of said hub and the hub center axis are substantially parallel.

* * * * *